US005954113A

United States Patent [19]

Buchborn

[11] Patent Number: 5,954,113

[45] Date of Patent: Sep. 21, 1999

[54] METHOD FOR PRODUCING LIGHT METAL CASTINGS AND CASTING MOLD FOR CARRYING OUT THE METHOD

[75] Inventor: Manfred Buchborn, Bornheim-Sechtem, Germany

[73] Assignee: Eisenwerk Bruehl GmbH, Bruehl, Germany

[21] Appl. No.: 08/817,980

[22] PCT Filed: Aug. 22, 1996

[86] PCT No.: PCT/EP96/03691

§ 371 Date: Apr. 25, 1997

§ 102(e) Date: Apr. 25, 1997

[87] PCT Pub. No.: WO97/07914

PCT Pub. Date: Mar. 6, 1997

[30] Foreign Application Priority Data

Aug. 28, 1995 [DE] Germany ..... 195 31 551

[51] Int. Cl.[6] ..... B22D 27/13

[52] U.S. Cl. ..... 164/61; 164/120; 164/285; 164/359

[58] Field of Search ..... 164/61, 66.1, 72, 164/113, 120, 137, 284, 285, 359, 369

[56] References Cited

U.S. PATENT DOCUMENTS 2,960,736 11/1960 Poudevigne .
5,076,341 12/1991 Noguchi .
5,297,610 3/1994 Noguchi et al. .

FOREIGN PATENT DOCUMENTS 1135619 8/1962 Germany .
2133421 1/1973 Germany .
2818442 10/1979 Germany .
95209456 4/1985 Japan .
61-52978 3/1986 Japan ..... 164/113
3-142056 6/1991 Japan ..... 164/120
668205 12/1988 Switzerland .
95/18689 7/1995 WIPO .

*Primary Examiner*—Kuang Y. Lin
*Attorney, Agent, or Firm*—Venable; George H. Spencer; Catherine M. Voorhees

[57] ABSTRACT

A method for producing light metal castings, in particular cylinder heads, cylinder blocks and/or crankcases for internal combustion engines, includes a sand mold which forms a mold cavity for the casting. The sand mold includes outer mold parts, at least one core and at least one feeder for forming a riser, wherein the mold is provided with an in-gate for receiving the metal melt and the metal melt is filled into the mold cavity under the effect of gravity. A cover core (5) is fitted onto the mold that is at least in partial regions designed to be impermeable to gas and which contains at least one feeder, and wherein immediately after the filling operation, the feeder filled with metal melt is admitted with a pressure via a pressurized gas.

16 Claims, 5 Drawing Sheets

METHOD FOR PRODUCING LIGHT METAL CASTINGS AND CASTING MOLD FOR CARRYING OUT THE METHOD

BACKGROUND OF THE INVENTION

The invention relates to a method for producing light metal castings, in particular cylinder heads, cylinder blocks and/or crankcases for internal combustion engines, with a sand mold for forming a molding cavity for the casting, which comprises outer mold parts, at least one core and at least one feeder for forming a riser, wherein the mold is provided with an in-gate for the metal melt and wherein the metal melt is filled into the molding cavity of the mold under the effect of gravity.

It is a known practice to use sand molds and permanent molds, so-called chill molds, for the production of light metal castings, as well as to use molds that are composed of permanent mold parts, so-called half-chills, and sand-casting mold parts. On the one hand, the main advantage of the series production of castings with the sand mold lies in this case in the high production speed for producing the sand molds and, on the other hand, in the high production speed for the casting with respect to the casting rate. In contrast to the casting with chill-molds, it is not necessary after each casting operation to wait for the mold to cool down before reusing it. Since it is also possible to recycle the sand used for producing the outer mold parts and the core, light metal castings such as cylinder heads for internal combustion engines, are nowadays cast at high productivity in sand molds. In this case, the metal melt is always poured into the sand mold under the effect of gravity, for the most part with the so-called gravity casting. To improve the texture, feeders are used at the mold, which contain a feeder material that matches the material of the casting for high-quality castings and functions as a so-called riser. For this, the somewhat coarser texture as well as the possibly occurring micro-porosity when casting in sand-based molds as compared to the casting in chill molds is accepted.

Furthermore a known method of low-pressure casting of light metal melts in permanent chill molds, wherein a fine, dense texture can be achieved by applying pressure with a gas to the melt inside the chill mold is disclosed in DE-A-21 33 421; and DE-A-28 18 442. The application of pressure is no problem because of the stability of the chill mold. However, since the chill molds have a very long cooling-down period, an extremely high number of very expensive chill molds are needed for high production speeds. Owing to the frequently occurring changes in the castings, a high number of chill molds must therefore be changed, or new ones must be produced.

From the DE-B-11 35 619 publication it is known to use a standard sand mold with a fixed upper frame and a fixed lower frame, wherein for the production of metal castings with a dense structure, the sand mold consisting of upper and lower frames is covered with a sealed dome or the upper and lower frame of the mold are connected such that they are sealed and a dome that is also sealed is placed over the free surface of the upper frame after the molding cavity of the mold has been filled with metal melt. The inside space of the dome is admitted with a pressurized gas, which then acts upon and compresses the melt via the porosity of the mold sand, in particular via the free melt surfaces in the region of the feeders and risers. This method is time-consuming despite the use of sand molds since either a complete dome must be placed in each case over the sand mold or care must be taken during the fitting together of the sand mold so that lower frame and upper frame as well as the pressure dome that is fitted on top are sealed completely when connected.

From U.S. Pat. No. 2,960,736 it is known that in order to solve the sealing problems, a pressure dome is fitted over the feeder opening, which is provided with a sealing collar that dips into the melt inside the feeder. The disadvantage of this system is, among other things, that a relatively large melt surface must exist in the end section of the feeder for sealing purposes, independent of the size of the castings to be cast, so that following the separation of the feeders from the finished casting a correspondingly large amount of material must be melted on again.

SUMMARY OF THE INVENTION

It is the object of the invention to improve the process of casting light metal castings under the effect of gravity and in sand molds with respect to the quality of the produced casting, in particular concerning an especially dense and fine-grained texture while avoiding micro-porosity, as well as to reduce the volume of the feeder material accruing in the form of a riser. Light metal within the meaning of the invention comprises in particular aluminum and aluminum alloys.

The solution according to the invention, with respect to the processing method, is that a cover core is fitted on the mold, which is gas-impermeable at least in partial regions, and which comprises at least one feeder, and that immediately after the filling operation, the feeder filled with metal melt is admitted with a pressure via a pressurized gas.

With the inventive processing method, it is possible even with sand molds to improve, condense and refine the texture of the solidifying metal melt through additionally admitting it with pressurized gas via the riser, as the arrangement of an air-impermeable cover core provides an immediate option for supplying the pressurized gas. At the same time, the volume or mass of the riser can be reduced by one half as compared to traditional casting methods with dead molds, so that a high savings in the circulating material can be achieved. In addition to the literal meaning for gas-impermeability, the term "gas-impermeable" within the meaning of the invention at hand also refers to gas-permeability with a high flow resistance, which for a pressure admitting ensures the desired pressure build-up above the melt with acceptably low losses through leaks.

Advantageous modifications of the inventive method will become apparent to those skilled in the art upon reading the following description. One preferred embodiment of the inventive method provides that the metal melt is admitted with pressure inside the feeder during the first critical solidifying phase for the metal melt, meaning while the metal melt is still hot, so that a corresponding influencing of the still liquid melt in the total mold space via the exerted pressure is possible. This first, critical solidifying phase extends approximately to a cooling temperature for the light metal melt of 500° C. Below this temperature, the admitting with pressure has only a limited effect.

In order to permit in a simple way the admitting of the metal melt in the feeder with pressure at the point in time when the filling operation is completed, but the metal melt has not yet solidified, it is suggested to section off a hollow space above the feeder and the cover core that contains the feeder, to seal off this space and provide it subsequently with a connection for admitting it with pressurized air. After the admitting of the feeder with pressure is completed, this sectioned-off hollow space can be used in a further processing step to apply a negative pressure to this space above the feeder and, at the same time, to vacuum off the gases that escape during the hot-casting from the mold.

In accordance with the invention, a (lost) mold is further suggested for carrying out the inventive method, which is characterized by outer mold parts, at least one core as well as at least one feeder for forming a riser, wherein a cover core with at least one feeder is provided, onto which a pressure dome is fitted that seals off the feeder region and wherein the cover core is designed to be gas-impermeable, at least in the region where the pressure dome is fitted on.

In a further modification of the inventive mold and for an accurate admitting with pressure, even with a sand-based cover core, it is suggested that the sand-based cover core that contains the feeder is made impermeable to gas by a layer of core black wash, applied to its surface at least in the region where the pressure dome is fitted on. The cover core itself can be composed of several individual cores to form a cover core, wherein each individual core must be designed to be gas-impermeable and wherein the individual cores must be connected tightly, at least in the feeder region. After the mold has been filled with metal, this cover core or the cover cores make it possible to apply a pressure by means of pressurized gas onto the feeders installed in the cover core, in order to achieve in this way an improved, more refined and more dense texture of the produced casting with simultaneously lower feed volume—riser volume—during the solidification.

Another advantageous embodiment provides that as a result of a corresponding selection of the mold material and the binder, the cover core is designed such that it can withstand a pressure of up to 1 bar. In order to carry out the inventive method, only low pressures below and up to 1 bar are needed to achieve the desired density and fine-grained texture.

In a further modification of the invention, the pressure dome provided on the cover core for producing a hollow space for the admitting with pressure can also be used to vacuum off the smoke that develops as a result of the thermal effect of the metal melt on the mold sand and the core sand. It must therefore be designed such that immediately following solidification of the metal melt and after completion of the admitting of the riser with pressure, a low pressure can be applied to the hollow space covered by the pressure dome. The pressure dome is provided with another connection for this, to which a vacuuming device can be attached.

One advantageous embodiment of the cover core seal involves the application of a core black wash as dispersion by means of immersion or spraying on. The surface treatment with a core black wash also results in an improved firmness of the cover core. Core black washes are known in principle as finishes for sand-based cores to achieve smooth and non-porous surfaces when producing castings from a gray cast iron.

Core black washes on the basis of a dispersion of fire-resistant filler materials in an organic solvent are provided as inventive finishes for a cover core so as to make it impermeable to gas. These core black washes can additionally contain graphite. The fire-resistant filler materials to be considered can include, for example, fire-resistant silicates such as zirconium silicate, magnesium and/or aluminum silicate. In addition, the core black wash can also contain iron oxide as fire-resistant filler material. The core black washes can furthermore contain small amounts of synthetic resins, that is up to 1% in weight.

The previously explained dispersions are possible black washes, but other material compositions can be used as well, which result in a gas-impermeable surface for the sand-based cores.

In order to further improve the texture for the inventive, sand-based mold for light metal castings, it is suggested to assign supporting shells to the outer mold parts of sand, which at least partially surround the mold and can be moved toward or away from the mold. The supporting shells that are preferably made of a permanent material, for example metal, function as outside pressure supports on the casting mold during the casting operation and to admit pressure during the critical first solidification phase of the metal melt in the casting mold.

The inventive casting mold permits a new and economical method for producing light metal castings through pouring by gravity, in particular also of such complicated parts as cylinder heads and cylinder blocks for internal combustion engines with a high casting quality by using sand-based molds for the outside mold as well as for the cores. It is possible to produce a dense, fine and even texture for the complete casting by way of the pressure, which is additionally exerted immediately after the completion of the casting operation onto the casting via the metal melt in the feeder, so that on the one hand the advantages of the sand-based lost mold can be utilized and, on the other hand, a high quality is achieved, such as normally can be achieved only for castings with a chill mold.

BRIEF DESCRIPTION OF THE DRAWINGS

The invention is explained in more detail with the aid of diagrammatic drawings of exemplary embodiments, in which.

DETAILED DESCRIPTION OF THE INVENTION

Figure 1:
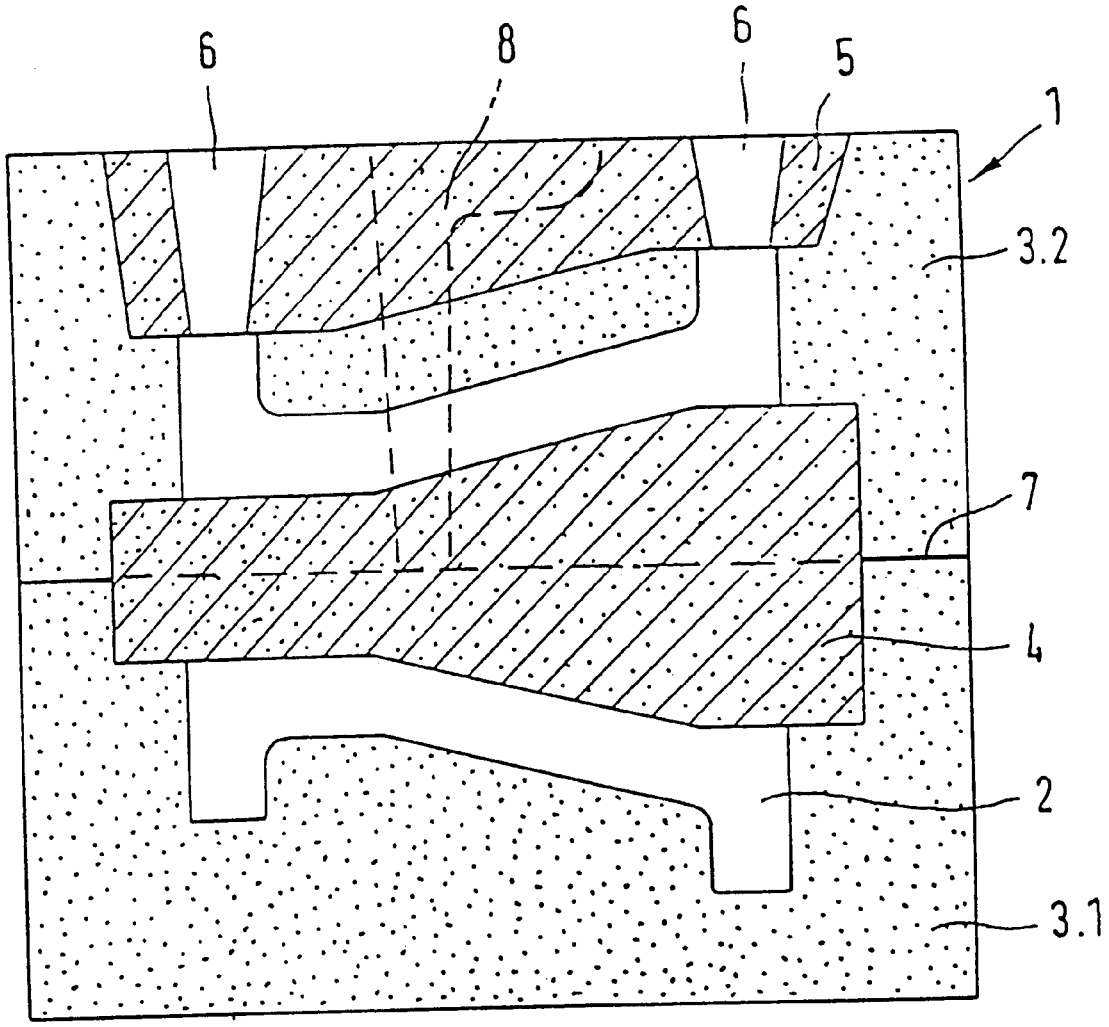
FIG. 1 is a diagrammatic illustration of a casting mold.

FIG. 1 is a cross-sectional view of a casting mold 1 for a simple rotation-symmetrical casting with a molding cavity 2. The mold 1 is designed as a lost mold with mold outside parts 3.1, 3.2 as well as an inserted core 4 and has a cover core 5, comprising feeders 6 for forming the riser. The mold outside parts 3.1 and 3.2 are joined at the separation joints 7. The core 4 can also be composed of several parts to form a core packet. The number and subdivisions of the mold outside parts and the produced cores 7 or core packets depend on the respective form in which the casting is to be poured. The casting mold 1 furthermore has an in-gate 8 for the metal melt. The cover core 5 as well can be fitted together of several core parts and can have one or several feeders 6.

Figure 2:
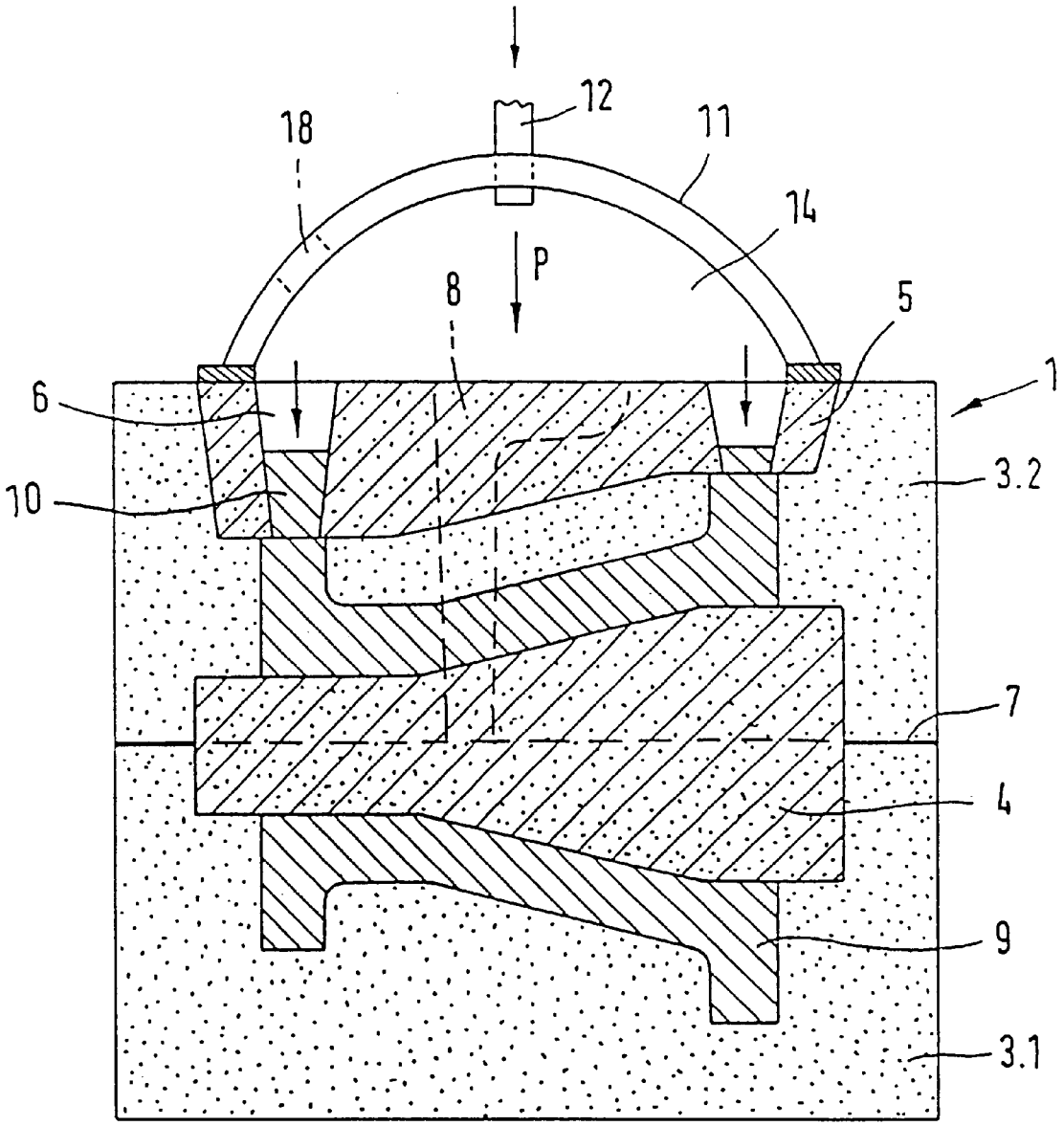
FIG. 2 Illustrates the fitting of the casting mold according to FIG. 1 with a pressure dome.

FIG. 2 shows the mold 1 after the metal melt has been poured in to fill the molding cavity and to produce a casting 9, wherein the riser 10 are present in the feeders for the cover core 5.

In order to achieve a condensing and evening out of the texture and to avoid micro-porosity after the mold cavity has been filled with metal melt, a gas pressure P is exerted via the feeders 6 onto the metal melt that forms the riser 10. This pressure P can range up to 1 bar.

A pressure dome 11 is fitted onto the cover core 5 such that it seals to be able to exert this pressure via the feeders 6 onto the metal melt in the mold cavity until solidification. The pressure dome 11 has a connection 12 for the compressed air supply.

The cover core 5 produced in the known way on the basis of sand is normally microporous and thus air-permeable. In order to be able to exert pressure onto the still liquid metal melt by means of compressed air via the feeders 6, the cover core 5 surface is coated with a core black wash, at least in the region covered by the pressure dome 11, thus making it impermeable to gas in the coated region. The cover core 5 surface can be sealed, for example, by submerging the cover core 5 into a core black wash. With the aid of the core black wash, e.g. on the basis of a dispersion of fire-resistant filler materials in an organic solvent such as zirconium silicate and carbon, small amounts of synthetic resin and isopropanol diluted with acetone and containing some water, the surface of the cover core 5 is made so dense and stable that the cover core 5 is air-impermeable and can withstand the added pressure P exerted via the pressure dome, as shown in the diagram in FIG. 2.

Essentially, it is only necessary to seal and render air-impermeable the cover core 5 by coating all those regions which come in contact with the compressed air. However, the submerging of the complete cover core into a respective core black wash is an economical method, which not only results in a corresponding sealing of the cover core surface, but also a higher stability.

If the cover core 5 is composed of several parts, then each part must be sealed with a core black wash prior to assembling.

The core black wash applied to the cover core must dry and solidify before the cover core is used.

The pressure P is applied to the casting by means of the pressure dome 11 fitted onto the mold until the solidification process for the light metal melt is finished, i.e. until a temperature below 500° C. is reached. This time depends on the size of the workpiece that is produced, e.g. approximately 1.5 minutes for a cylinder block for internal combustion engines with a casting weight of approximately 20 to 22 kg.

Figure 3:
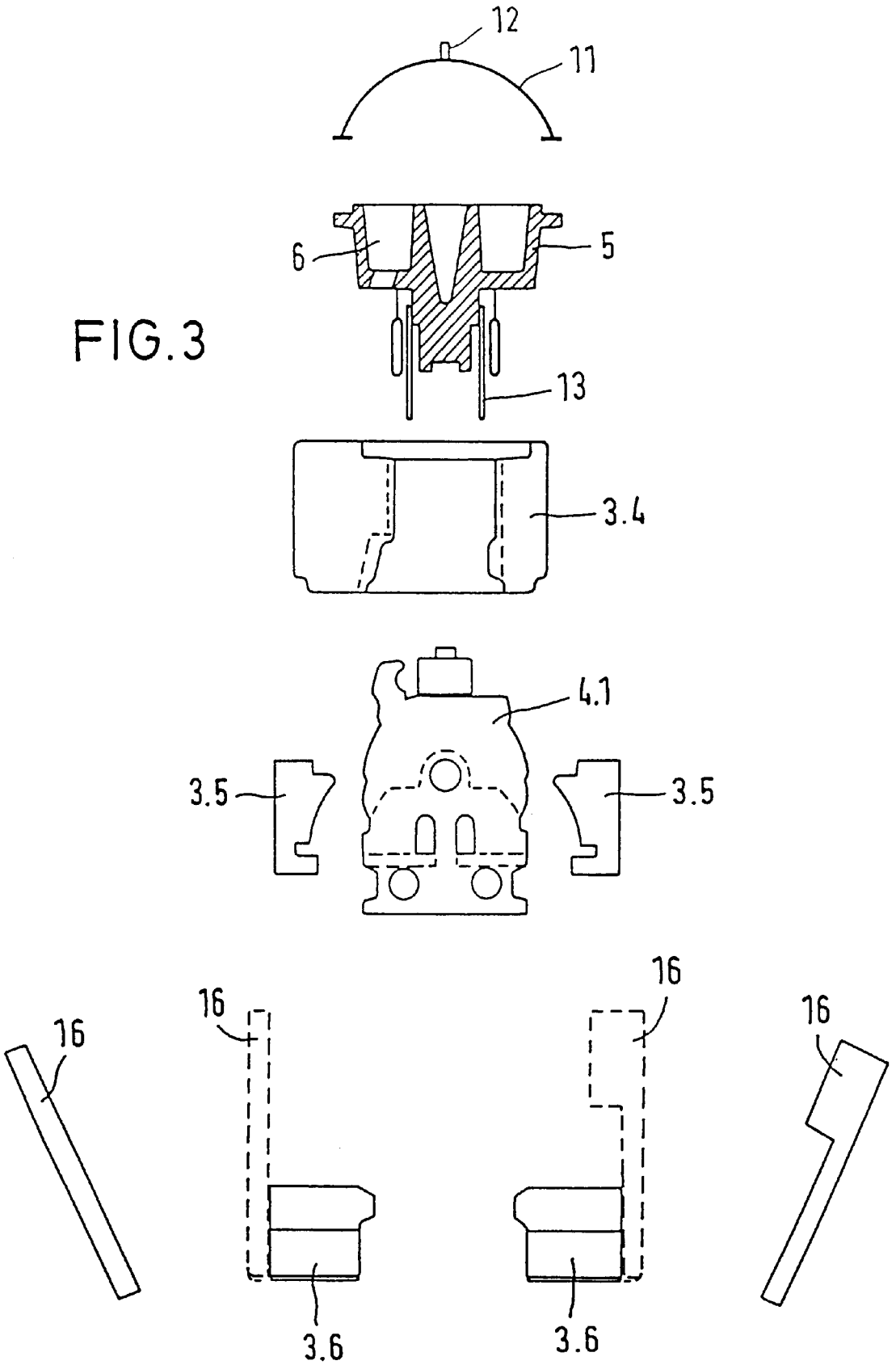
FIG. 3 A diagrammatic, exploded view of a casting mold for a crankcase, as seen from the side.

In FIG. 3, the use of the invention for producing a crankcase for internal combustion engines is shown is an exploded view of the necessary casting mold parts. The outer casting mold is here formed by the upper mold block 3.4, the side mold parts 3.5 as well as the lower mold parts 3.6, which can also be composed of individual core parts, depending on the configuration. The core block 4.1, which is also called crankcase core block, is again composed of individual core parts. The cover core 5 forms the upper part of the mold. All casting mold parts as well as the core block 4.1 and the cover core 5 are produced as sand-based lost molds. The cover core 5 here can have an additional part 13, namely a cylinder liner, that later on remains in the casting.

The cover core 5 contains at least one feeder 6 for the riser and is furthermore covered on the top with the pressure dome 11. The pressure dome 11 is fitted such that it seals onto the cover core 5 and the hollow space 14 thus created over the cover core 5 can then be admitted with a pressure via the compressed air that is fed in via the connection 12, so that a pressure can additionally be exerted in the-feeding region onto the metal melt inside the mold until solidification.

The cover core 5 can also be located on the opposite side of the crankcase, so that the mold is turned by 180°.

Supporting shells 16, which act upon the outer mold parts 3.4, 3.5, 3.6, can be provided to stabilize the casting mold during the casting operation to increase the form precision, and to exert an additional pressure from the outside onto the casting mold. These supporting shells 16 can, for example, be folded down at the casting location prior to removing the casting and after solidification.

Figure 4:
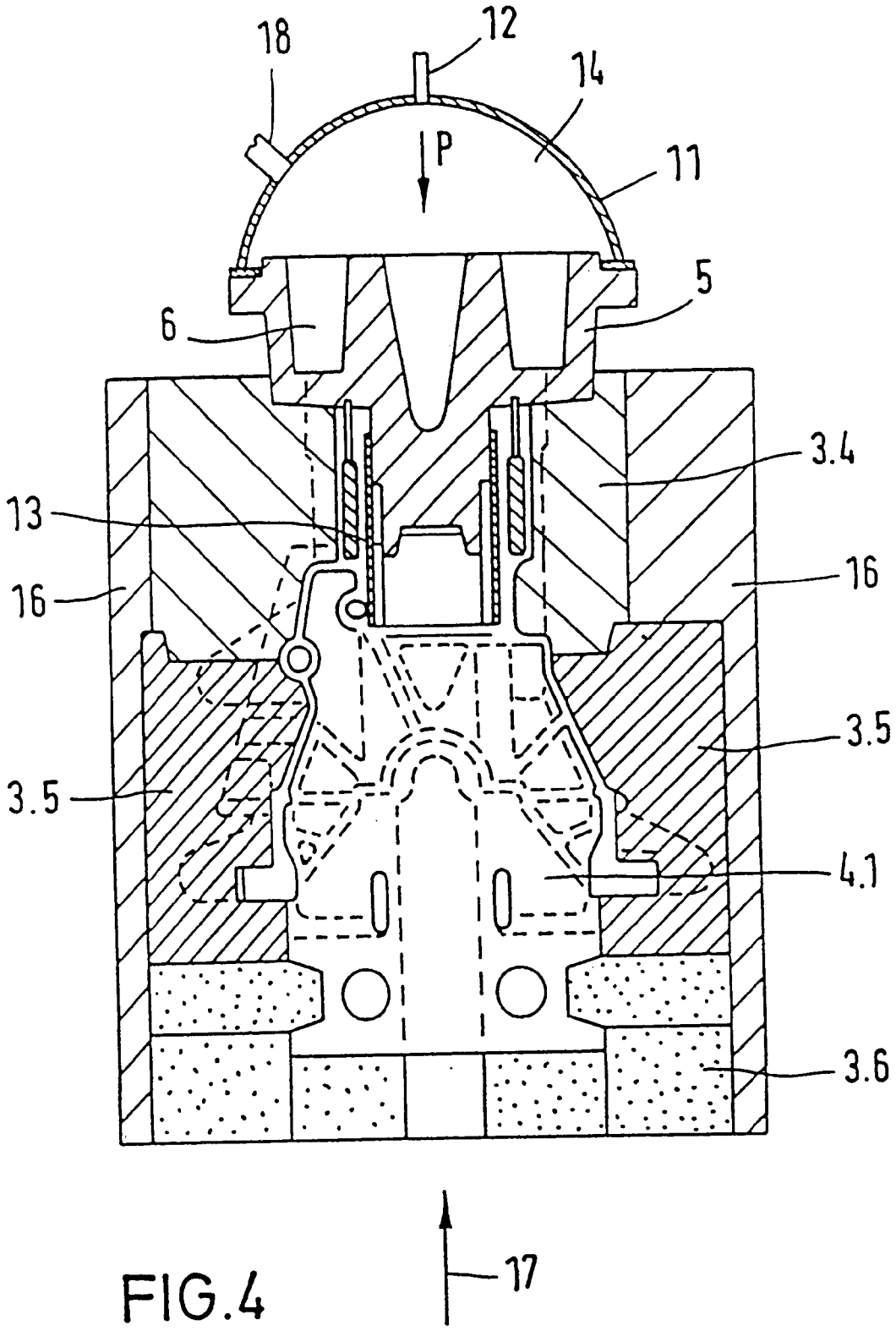
FIG. 4 is a diagrammatic illustration of the casting mold according to FIG. 3 in the assembled state.

FIG. 4 shows a cross-sectional diagram of the sand-based lost mold described in FIG. 3 for a crankcase, in the assembled condition. The arrow 17 designates the direction in which the extractors work after the supporting shells 16 have been moved to the side. Here too, the cover core 5 is coated on its surface with a core black wash and treated to make it air-impermeable, thus permitting the admitting with a pressure of up to 1 bar via the pressure dome 11.

After admitting the cover core 5 with pressure, meaning after this is completed, it is possible via a second connection 18 to suction off flue gases that have collected in the hollow space 14 formed by the pressure dome 11, which gases escape and collect from the mold parts in particular through the effects of the hot melt.

Figure 5:
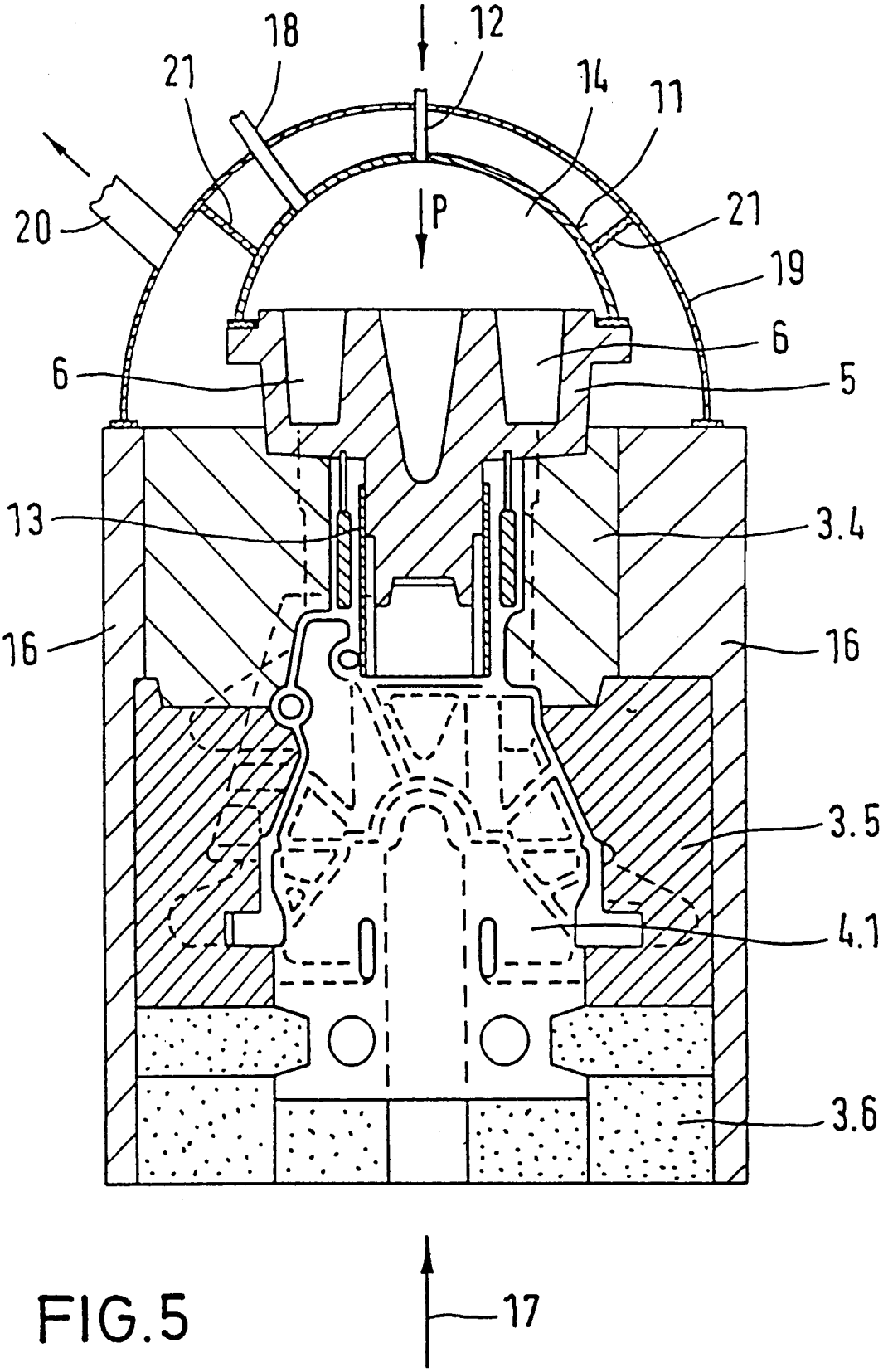
FIG. 5 is a casting mold according to FIG. 1 with additional bell for suctioning.

FIG. 5 shows a modification of the invention, wherein another suction bell 19 is fitted at a distance over the pressure dome 11, so that this second suction bell covers the upper part of even the outer mold part region, so that all flue gases developing as a result of the casting heat and which escape from the mold upward can be suctioned off from under the suction bell 19 via the connection piece 20. It is possible to connect the pressure dome 11 and the suction bell 19 via supports 21. The pressure dome 11 as well as the suction bell 19 are fitted onto the cover core 5 or the outer mold parts such that they form a seal. The connections 12 and 20 are connected to respective compressed gas feed and suction devices.

I claim:

1. A method for producing light metal castings, comprising the steps of:

obtaining a sand mold to form a mold cavity for the casting, said sand mold including outer mold parts, and at least one sand-based core;

fitting a sand-based cover core onto the sand mold to cover the mold cavity, said sand-based cover core being gas-impermeable at least in partial regions and comprises at least one feeder for receiving a pressurized gas and in which a riser is formed;

filling the mold cavity with metal melt through an in-gate located in one of the sand mold or the sand-based cover core, the metal melt flowing into the mold cavity under the effect of gravity; and following the metal melt filling step, sealingly attaching a device for supplying the pressurized gas to the gas-impermeable partial regions of the sand-based cover core and applying pressure to the at least one feeder filled with metal melt via the pressurized gas.

2. The method according to claim 1, wherein the light metal castings produced are cylinder heads, cylinder blocks and/or crankcases for internal combustion engines.

3. The method according to claim 1 wherein the at least one feeder, which is filled with metal melt, is admitted with a pressurized gas up to about 1 bar.

4. The method according to claim 1, wherein the cover core is made gas-impermeable by applying a core black wash to at least partial regions of the cover core.

5. The method according to claim 1, wherein the metal melt in the at least one feeder is admitted with pressure during the first critical solidification phase of the metal melt.

6. The method according to claim 1, wherein the applying pressure step continues until the metal, which has been poured into the mold, has reached a temperature below 500° C.

7. The method according claim 1, wherein the device which is sealingly attached to the cover core forms a hollow space above the cover core, the hollow space being admitted with the pressurized gas in order to apply pressure to the at least one feeder.

8. The method according to claim 7, wherein after the applying pressure step has ended, a negative pressure is applied to the hollow space.

9. A method for producing light-metal castings, comprising the steps of:

obtaining a sand mold to form a mold cavity for the casting, the sand mold comprising outer mold parts, at least one sand-based core and at least one feeder for forming a riser, a sand-based cover core that is gas-impermeable at least in some sections comprises the at least one feeder and is sealingly fitted onto the sand mold;

filling the sand mold with metal melt through an in-gate, the metal melt flowing into the mold cavity under the effect of gravity; and immediately following the filling of the metal melt into the mold cavity, applying pressure to the at least one feeder filled with metal melt by admitting it with a compressed gas wherein a feeding device for the compressed gas is attached to the gas-impermeable partial sections of the sand-based cover core so as to form a seal.

10. A casting mold for producing light metal castings, comprising:

a sand mold to form a mold cavity for the casting, said sand mold including outer mold parts and at least one sand-based core;

a sand-based cover core with at least one feeder for receiving a pressurized gas and in which a riser is formed, said sand-based cover core being fitted onto the sand mold to cover the mold cavity; and a pressure dome that is sealingly attached to the sand-based cover core to seal off a pressurized gas feeding region, wherein the sand-based cover core is gas-impermeable, at least in the region covered by the pressure dome.

11. A casting mold according to claim 10, wherein the cover core is sand-based and is made gas-impermeable by applying- a core black wash to its surface, at least in the region covered by the pressure dome.

12. A casting mold according to claim 11, wherein the sand-based cover core can withstand a pressure of up to 1 bar during the admitting of the feeding region with pressure.

13. A casting mold according to claim 11, wherein the core black wash is applied in the form of a dispersion to the cover core by means of dipping or spraying.

14. A casting mold according to claim 10, further comprising support shells which are assigned to the outer mold parts, said support shells encircling the outer mold parts at least in part and can be moved toward or away from the sand mold.

15. A casting mold according to claim 10, further comprising a connection for suctioning off gases, said connection being attached to said pressure dome.

16. A casting mold according to claim 10, further comprising a bell, which can be fitted over the pressure dome onto the sand mold such that it seals and spans at least the cover core, said bell being provided with a connection for admitting a negative pressure inside the bell.

* * * * *